United States Patent [19]

Senn

[11] 4,084,916

[45] Apr. 18, 1978

[54] STEEL MESH SYSTEM AND BRACKETS

[76] Inventor: Charles Senn, 12633 Wilfred Ave., Detroit, Mich. 48213

[21] Appl. No.: 753,217

[22] Filed: Dec. 22, 1976

[51] Int. Cl.[2] ..... E01C 11/16

[52] U.S. Cl. ..... 404/134; 52/581; 24/70 CT

[58] Field of Search ..... 404/134, 135; 24/70; 52/135 N, 721, 584, 664, 581; 403/396, 404, 398, 399, 393

[56] References Cited

U.S. PATENT DOCUMENTS

| | | | |
|---|---|---|---|
| 184,957 | 12/1876 | Doeg | 403/399 X |
| 1,552,333 | 9/1925 | Mosher | 52/721 |
| 1,878,992 | 9/1932 | Shezton | 404/134 |
| 1,932,010 | 10/1933 | Becker | 403/398 X |
| 1,981,685 | 11/1934 | Blackburn | 403/396 X |
| 2,313,211 | 3/1943 | Aldrich | 52/581 X |
| 2,315,448 | 3/1943 | Nagin | 52/581 X |
| 2,398,504 | 4/1946 | Pavelka | 403/396 X |
| 2,737,637 | 3/1956 | Scott | 403/396 X |

*Primary Examiner*—Nile C. Byers
*Attorney, Agent, or Firm*—Whittemore, Hulbert & Belknap

[57] ABSTRACT

A steel mesh system for reinforcing concrete for airport landing strips and the like, comprising at least two mesh sections, each including separate groups of spaced apart parallel steel bars positioned perpendicularly to each other and welded together at their intersection, placed side by side, and rigid brackets securing peripheral aligned rods at adjacent sides of the mesh sections together. Each bracket is substantially U-shaped defining a recess to receive the peripheral rods and includes two leg portions separated by a connecting portion. One of the leg portions of each bracket is undercut so that the opening of the recess is of smaller extent than the bottom of the recess. A set screw having a convex end extends through the free end of the other leg of the U-shaped member outwardly of the recess with respect to the center of the parallel bars positioned within the recess.

3 Claims, 3 Drawing Figures

STEEL MESH SYSTEM AND BRACKETS

BACKGROUND OF THE INVENTION

1. Field of the Invention

The invention relates to concrete reinforcing mesh and refers more specifically to a system of heavy steel mesh sections for reinforcing concrete airport landing strips or the like, and brackets securing the steel mesh sections together.

2. Description of the Prior Art

In the past, heavy steel reinforcing mesh sections for reinforcing concrete airport landing strips and the like have been overlapped and wired together to form a complete reinforcing system. Alternatively, separate reinforcing rods have been provided at the edges of the steel mesh reinforcing sections, and the additional reinforcing bars have been wired to the reinforcing mesh sections to secure the mesh sections together. Additionally, at times the reinforcing mesh is produced with overlapping extensions on the sides thereof which are then overlapped and secured together by wire or the like.

Reinforcing mesh with the added extensions is difficult to handle. Providing additional reinforcing bars at the intersection of the steel mesh sections requires coordination of supplies of different kinds of mesh and rods as well as the securing of the extra rods in place at the intersections of the steel mesh sections. Further, the overlapping of the steel mesh sections and/or extra rods is not always structurally necessary and therefore an unnecessary expense.

SUMMARY OF THE INVENTION

Accordingly, a heavy steel mesh reinforcing system for concrete airport landing strips or the like has been developed which includes unique reinforcing mesh structure including peripheral bars at the edges of the mesh sections, and brackets for securing the peripheral bars of adjacent mesh sections together.

The brackets are generally U-shaped, having a pair of leg portions and a connecting portion forming a recess. One of the leg portions is undercut, whereby the opening of the recess is smaller than the bottom thereof, and a set screw having a convex end extends through the free end of the other leg portion of the bracket outwardly of the recess with respect to the center of the peripheral bars to be secured thereby.

DESCRIPTION OF THE PREFERRED EMBODIMENT

Figure 1:
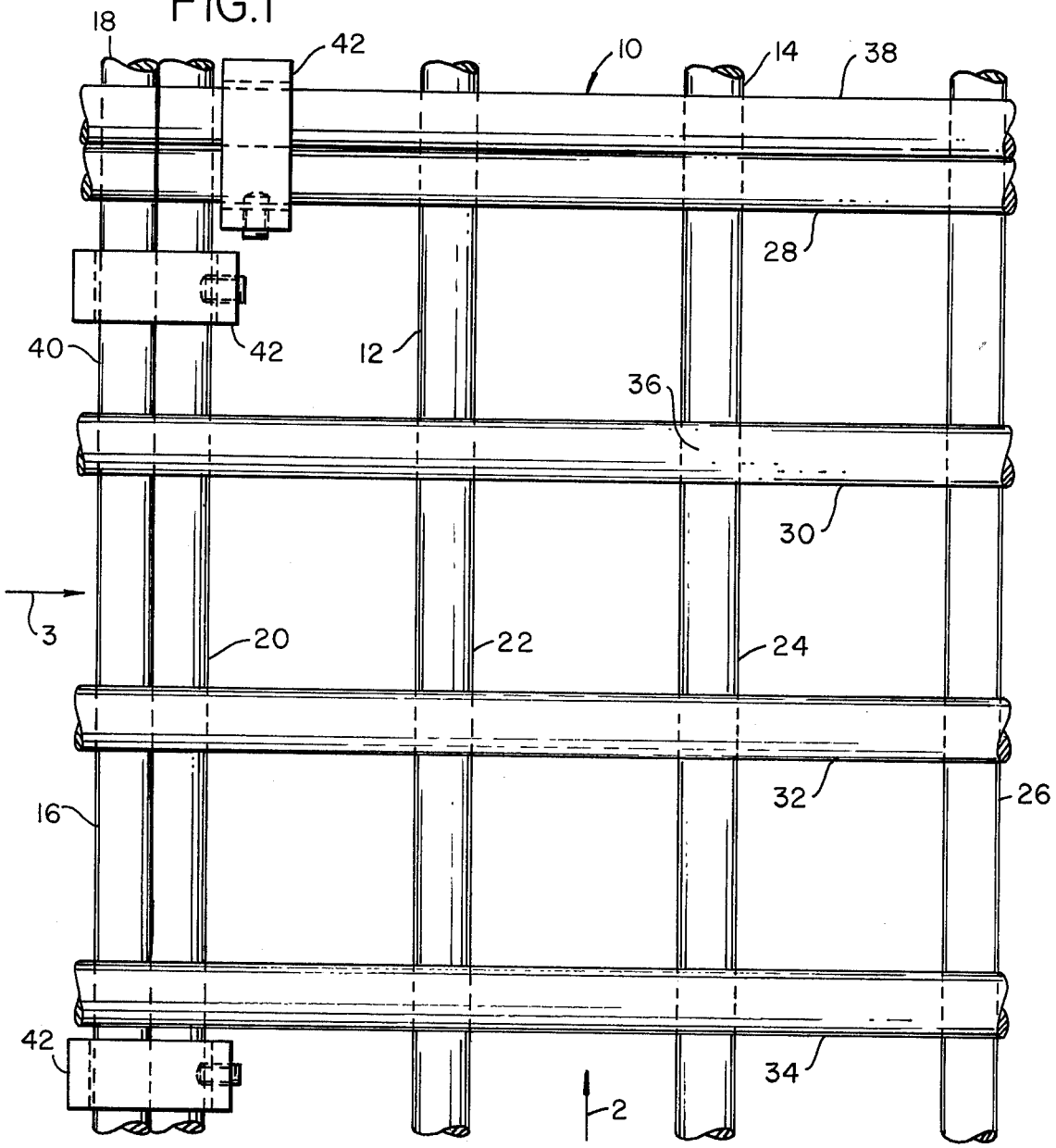
FIG. 1 is a plan view showing the intersection of the corners of four separate heavy reinforcing mesh sections, the peripheral rods of which are secured together by brackets, all in accordance with the invention.

As shown best in FIG. 1, the steel mesh reinforcing system 10 of the invention includes separate heavy steel mesh sections 12, 14, 16 and 18. Each of the steel mesh sections 12, 14, 16 and 18 are entirely similar. Only steel mesh section 12 will therefore be considered in detail.

The steel mesh section 12 includes a plurality of parallel spaced apart rods 20, 22, 24 and 26 for example in a one-foot section spaced approximately four inches apart. The individual rods may be ¾ inch round steel reinforcing rods. The steel mesh section 12 further includes the parallel spaced apart rods 28, 30, 32 and 34 which may also be ¾ inch rods.

As shown, the rods 20, 22, 24 and 26 extend perpendicularly to rods 28, 30, 32 and 34. The rods in both groups of parallel rods are welded together in manufacture of the mesh at their intersections 36.

Rods 20 and 28 in mesh section 12 are peripheral rods and are welded to the ends of rods 28, 30, 32 and 34 and to the ends of rods 20, 22, 24 and 26, respectively.

The steel mesh section 14 has the peripheral rod 38 which, as shown, extends parallel to and in contact with peripheral rod 28 of mesh section 12. Mesh section 16 includes the peripheral rod 40 which extends parallel to and in contact with peripheral rod 20 of mesh section 12. Rods 28 and 38 and rods 20 and 40 are secured together by brackets 42 to form an overall steel mesh system in accordance with the invention.

Each of the brackets 42, three of which are illustrated in FIG. 1, are identical. The brackets 42, as shown, are U-shaped including a connecting portion 44 extending between leg portions 46 and 48. The connecting and leg portions together form a recess 50. Recess 50 has an opening 52 and a bottom 54 separated by side walls 56 and 58, as best shown in FIG. 2.

Figure 2:
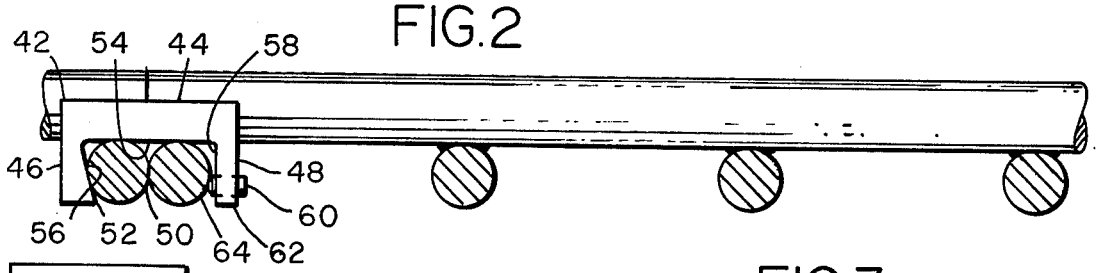
FIG. 2 is a section view of the reinforcing mesh system illustrated in FIG. 1, taken substantially in the direction of arrow 2 in FIG. 1.
Figure 3:
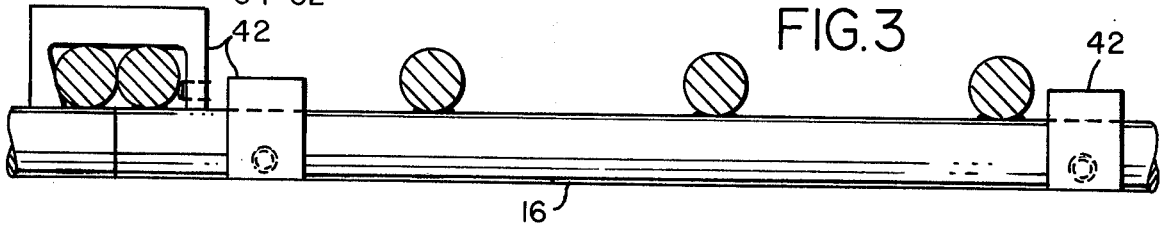
FIG. 3 is a section view of the reinforcing mesh system illustrated in FIG. 1, taken substantially in the direction of arrow 3 in FIG. 1.

The side wall 56 of the recess 50 slopes toward the side wall 58 outwardly of the recess 50, again as shown best in FIG. 2, due to undercutting of the leg 46 of the U-shaped bracket 42. The opening 52 of the recess 50 is therefore of less extent between the leg portions of the U-shaped bracket 42 than the bottom surface 54 of the recess 50.

A set screw 60 extends through the free end 62 of the leg portion 48 of the U-shaped bracket 42 outwardly from the bottom 54 of the recess 50 a distance greater than the radius of the peripheral rods to be secured together by the bracket 42, as shown best in FIG. 2. The set screw 60 further has a convex end 64 thereon in a preferred embodiment to insure proper contact with the peripheral rods being secured together.

Thus, in installation of a heavy steel mesh system 10, in accordance with the invention, with the bracket 42 of the invention, the heavy steel mesh sections are manufactured with peripheral rods such as 20 and 28, 40 and 38, and are placed side by side with their peripheral rods parallel and in linear contact, as shown in FIG. 1. Brackets 42 are positioned over the adjacent peripheral rods such as rods 20 and 40, as shown in FIG. 2, with the set screw 60 removed from the recess 50 to permit insertion of the bracket 42 over the peripheral rods as shown. The set screw 60 is then screwed into the recess to force the bracket to the right, as shown in FIG. 2, so that the inclined surface 56 contacts rod 40 outwardly of the center of the rod 40 with respect to the opening 52. At this time, the set screw 60 will also engage the rod 20 outwardly of the center of the rod 20 with respect to the opening 52 of the recess 50. On tightening of the set screw 60, the peripheral rods 20 and 40 and therefore the mesh sections 12 and 16 will be secured together.

As many brackets as necessary may be positioned on the peripheral rods of the mesh sections and as many mesh sections as required for a reinforcing system may be secured together in side by side relation, as shown in FIG. 1, by means of the brackets 42.

While one embodiment of the present invention has been considered in detail, it will be understood that other embodiments and modifications of the invention are contemplated by the inventor. Thus, for example, all the reinforcing bars need not necessarily be aligned in adjacent mat sections, and extensions of at least some of the bars may be provided beyond the peripheral bars to be secured together, if desired. Also, the end of the set screw may be conical, etc. rather than spherical as shown. It is the intention to include all embodiments and modifications of the invention as are defined by the appended claims within the scope of the invention.

What I claim as my invention is:

1. A heavy steel mesh reinforcing system for airport runways or the like comprising at least two steel mesh sections each including a plurality of spaced apart parallel steel bars in each of two mutually perpendicular directions welded together at their intersections and including peripheral bars positioned side by side with one peripheral rod in each mesh section extending parallel to one peripheral rod in the other mesh section and in linear side by side contact therewith, the parallel rods in each of the mesh sections being axially aligned with corresponding rods in another mesh section, and rigid bracket means securing said peripheral rods in side by side contact together, which bracket means comprises a U-shaped member having a substantially straight flat connecting portion and two leg portions extending substantially perpendicularly from the ends of the connecting portion in the same direction defining a recess for receiving the peripheral rods in side by side contact therein, one of said leg portions having a surface forming an inner surface of the recess which is inclined toward the outer end of the connecting portion of the bracket means from the free end of the one leg portion whereby the one leg portion is narrower at the connection thereof with the connecting portion than it is at the free end thereof, the other surfaces of the leg portions of the bracket extending perpendicularly to the connecting portion thereof and a set screw extending perpendicularly through the other leg portion of the bracket having a center line parallel to the connecting portion and outwardly of the other leg portion of the connecting bracket toward the free end thereof from the center line of the peripheral rods in side by side contact whereby the peripheral rods in side by side contact are secured together by the bracket means within the recess formed by the bracket means.

2. Structure as set forth in claim 1 wherein the leg portions of the bracket means are of substantially the same length as the diameter of the peripheral rods in side by side contact.

3. Structure as set forth in claim 1 wherein the inner end of the set screw is convex.

* * * * *